US009290339B2

(12) United States Patent
Fukunaga

(10) Patent No.: US 9,290,339 B2
(45) Date of Patent: Mar. 22, 2016

(54) SHEET FEED CASSETTE, PAPER SHEET CONVEYING DEVICE, AND IMAGE FORMING APPARATUS

(71) Applicant: KYOCERA Document Solutions Inc., Osaka-shi, Osaka (JP)

(72) Inventor: Yasuyuki Fukunaga, Osaki (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/437,471

(22) PCT Filed: Oct. 16, 2013

(86) PCT No.: PCT/JP2013/078030

§ 371 (c)(1),
(2) Date: Apr. 21, 2015

(87) PCT Pub. No.: WO2014/065164

PCT Pub. Date: Jan. 5, 2014

(65) Prior Publication Data

US 2015/0274449 A1 Oct. 1, 2015

(30) Foreign Application Priority Data

Oct. 25, 2012 (JP) ..... 2012-236007

(51) Int. Cl.
*B65H 9/12* (2006.01)
*B65H 1/08* (2006.01)
(Continued)

(52) U.S. Cl.
CPC .. *B65H 1/08* (2013.01); *B65H 1/04* (2013.01); *B65H 1/266* (2013.01); *B65H 9/04* (2013.01); *B65H 9/08* (2013.01); *B65H 2301/41352* (2013.01);
(Continued)

(58) Field of Classification Search
CPC ..... B65H 2301/41352; B65H 2301/413523; B65H 2405/1122; B65H 2701/113; B65H 2701/1131
USPC ..... 271/171
See application file for complete search history.

(56) References Cited

U.S. PATENT DOCUMENTS

| | | | | |
|---|---|---|---|---|
| 4,757,725 | A * | 7/1988 | Beugin | 74/422 |
| 5,806,244 | A * | 9/1998 | Tilli | E05F 11/423 49/349 |
| 2008/0089730 | A1* | 4/2008 | Bryant et al. | 400/76 |
| 2011/0210501 | A1 | 9/2011 | Shiokawa et al. | |

FOREIGN PATENT DOCUMENTS

| | | | |
|---|---|---|---|
| JP | 2001310824 | A | 11/2001 |
| JP | 2008081263 | A | 4/2008 |

(Continued)

OTHER PUBLICATIONS

ISA Japanese Patent Office, International Search Report Issued in Application No. PCT/JP2013/078030, Jan. 21, 2014, WIPO, 4 pages.

*Primary Examiner* — Howard Sanders
(74) *Attorney, Agent, or Firm* — Alleman Hall McCoy Russell & Tuttle LLP

(57) ABSTRACT

A sheet feed cassette includes an end cursor, a pair of gears, and a pair of racks. The end cursor regulates a rear end position of stored paper sheets in the sheet feed direction. The end cursor is slidable in the conveyance direction. The pair of gears are rotatably provided on a lower surface of a base portion of the end cursor and have the same module and the same number of teeth. The pair of racks are provided on a bottom surface of a cassette main body in parallel with each other along a slide direction of the end cursor. The pair of racks respectively mesh with the pair of gears. This makes it possible to prevent a defect such as skewing, a folded edge, or a wrinkle from occurring, allowing the end cursor to slide smoothly with excellent operability.

6 Claims, 7 Drawing Sheets

(51) Int. Cl.

| | |
|---|---|
| ***B65H 1/04*** | (2006.01) |
| ***B65H 1/26*** | (2006.01) |
| ***B65H 9/04*** | (2006.01) |
| ***B65H 9/08*** | (2006.01) |

(52) U.S. Cl.
CPC .... *B65H 2301/4222* (2013.01); *B65H 2403/41* (2013.01); *B65H 2405/1122* (2013.01); *B65H 2511/11* (2013.01); *B65H 2801/06* (2013.01)

(56) References Cited

FOREIGN PATENT DOCUMENTS

| | | | |
|---|---|---|---|
| JP | 2010030761 | A | 2/2010 |
| JP | 2010189085 | A | 9/2010 |
| JP | 2011178493 | A | 9/2011 |
| JP | 2012158475 | A | 8/2012 |

* cited by examiner

SHEET FEED CASSETTE, PAPER SHEET CONVEYING DEVICE, AND IMAGE FORMING APPARATUS

TECHNICAL FIELD

The present invention relates to a sheet feed cassette including an end cursor for aligning stored paper sheets, a paper sheet conveying device, and an image forming apparatus.

BACKGROUND ART

In an image forming apparatus, such as a copier, a printer, or a facsimile, that forms an image on a paper sheet by the electrophotography, a sheet feed cassette for storing paper sheets is provided so as to be attachable/detachable to the apparatus main body. Here, a configuration of a conventional sheet feed cassette is described in the following with reference to FIGS. 8 through 11.

FIG. 8 is a perspective view of the conventional sheet feed cassette. FIG. 9 is a perspective view of a side cursor, and its peripheral, of the sheet feed cassette. FIG. 10 is a perspective view of an end cursor, and its peripheral, of the sheet feed cassette. FIG. 11 is a perspective view of the end cursor.

As shown in FIG. 8, a sheet feed cassette 105 includes a cassette main body 105A that is in the shape of a flat rectangular box whose top is opened. The sheet feed cassette 105 includes a paper sheet mounting plate 107, a pair of side cursors 108, and an end cursor 109. The paper sheet mounting plate 107 can sway about a fulcrum 107*a*. The pair of side cursors 108 can be slid so as to abut on opposite sides of the paper sheets mounted on the paper sheet mounting plate 107 and align the width of the paper sheets. The end cursor 109 can be slid so as to abut on the rear end of the paper sheets and align the front and rear ends of the paper sheets.

As shown in FIG. 9, the pair of side cursors 108 are respectively provided with claw portions (not shown) that have protruding-and-recessed surfaces so as to be engaged with racks 111 that are formed along the slide direction of the side cursors 108. When a knob member 110 is picked and pressed, the engagement between the claw portions and the racks 111 is disengaged and the pair of side cursors 108 are slid by the same amount in opposite directions along the paper sheet width direction by a rack and pinion mechanism (not shown). Subsequently, when the force pressing the knob member 110 is released, the claw portions are engaged with the racks 111 again and the sliding of the side cursor 108 is locked, and the side cursors 108 is fixed at that position.

In addition, as shown in FIG. 11, knob members 112 that can be elastically deformed are integrally formed with the end cursor 109 respectively at the left and right ends thereof. Claw portions 112*a* having projecting-and-recessed surfaces are respectively formed at lower ends of the knob members 112. As shown in FIG. 10, on the bottom surface of the cassette main body 105A, a guide groove 116 is formed along the slide direction of the end cursor 108. Furthermore, racks 117 extending in the slide direction of the end cursor 109 are formed in parallel with each other on both sides of the guide groove 116.

A guide projection 109*a* which is integrally formed with the end cursor 109 is fitted in the guide groove 116, and the claw portions 112*a* formed on the knob members 112 at the left and right sides of the end cursor 109 are engaged with the racks 117 on the left and right sides, respectively. When the knob members 112 on the left and right sides are picked and pressed inward, the knob members 112 are bent inward, and the engagement between the claw portions 112*a* under the knob members 112 and the racks 117 is disengaged. This allows the end cursor 109 to slide along the guide groove 116. Subsequently, when the force pressing the knob members 112 is released, the claw portions 112*a* are engaged with the racks 117 again and the sliding of the end cursor 109 is locked, and the end cursor 109 is fixed at that position.

Meanwhile, there is known a configuration of a sheet feed cassette where the side cursors and the end cursor are provided in an attachable/detachable manner, and the attachment positions thereof can be replaced with each other. In addition, in this configuration, when tab sheets are stored in the sheet feed cassette, both sides of the tab sheets are supported by the end cursor and one side cursor, and the rear end of the tab sheets is supported by the other side cursor (see Patent Literature 1). With this configuration, in both cases of tab sheets and normal paper sheets, it is possible to store the sheets in the state where the rear end of the sheets is aligned, without attaching and/or detaching any other member.

Furthermore, with regard to an image forming apparatus that includes: a sheet feed cassette having an end cursor; and a sheet feed roller unit that is supported by a drive shaft which extends perpendicular to the sheet feed direction, there is known a configuration where the sheet feed roller unit is supported at a position closer to one side of the drive shaft than the center of the drive shaft, and the end cursor includes an expanded portion that has been expanded toward the other side of the drive shaft (see Patent Literature 2). With this configuration, it is possible to prevent skewing of a paper sheet in the earlier stage of the sheet feed in the sheet feed cassette.

CITATION LIST

Patent Literature

[PTL 1] Japanese Laid-Open Patent Publication No. 2008-081263

[PTL 2] Japanese Laid-Open Patent Publication No. 2010-030761

SUMMARY OF THE INVENTION

Problems to be Solved by the Invention

Meanwhile, to prevent the skewing of paper sheets in the image forming apparatus, it is necessary to place, from above, paper sheets at a predetermined position in the sheet feed cassette, and set the paper sheets at the predetermined position accurately by positioning the both side cursors and end cursor at the both side ends and rear end of the paper sheets.

According to the conventional configuration, shown in FIGS. 8 through 11, for fixing the end cursor 109 in the sheet feed cassette 105, the claw portions 112*a* formed on the knob members 112 at the left and right sides of the end cursor 109 are engaged with the racks 117 on the left and right sides, respectively. With this configuration, the meshing of the protrusions and recessions (teeth) between the claw portions 112*a* and the racks 119 may be shifted by one or two locations due to a deflection or looseness of the end cursor 109. In that case, the end cursor 109 is inclined from the normal attitude. When the end cursor 109 is inclined from the normal attitude, the set state of the paper sheets is also inclined, and a defect such as skewing, a folded edge, or a wrinkle may occur.

Furthermore, when the end cursor 109 is inclined from the normal attitude, the sliding of the end cursor 109 may be interrupted and become difficult to slide, resulting in a low operability of the end cursor 109.

The present invention has been made in view of such conventional circumstances, and it is an object of the present invention to provide a sheet feed cassette, a paper sheet conveying device, and an image forming apparatus that can prevent occurrence of a defect such as skewing, a folded edge, or a wrinkle, and can allow the end cursor to slide smoothly with excellent operability.

Solution to the Problems

A sheet feed cassette according to one aspect of the present invention includes an end cursor, a pair of gears, and a pair of racks. The end cursor regulates a rear end position of stored paper sheets in the sheet feed direction. The end cursor is slidable in the sheet feed direction. The pair of gears are rotatably provided on a lower surface of a base portion of the end cursor and have the same module and the same number of teeth. The pair of racks are provided on a bottom surface of a cassette main body in parallel with each other along a slide direction of the end cursor. The pair of racks respectively mesh with the pair of gears.

A paper sheet conveying device according to another aspect of the present invention includes a sheet feed cassette and a sheet feed portion. The sheet feed portion conveys paper sheets stored in the sheet feed cassette. The sheet feed cassette includes an end cursor, a pair of gears, and a pair of racks. The end cursor regulates a rear end position of stored paper sheets in the sheet feed direction. The end cursor is slidable in the sheet feed direction. The pair of gears are rotatably provided on a lower surface of a base portion of the end cursor and have the same module and the same number of teeth. The pair of racks are provided on a bottom surface of a cassette main body in parallel with each other along a slide direction of the end cursor. The pair of racks respectively mesh with the pair of gears.

An image forming apparatus according to a further aspect of the present invention includes a sheet feed cassette and an image forming portion. The sheet feed cassette includes an end cursor, a pair of gears, and a pair of racks. The end cursor regulates a rear end position of stored paper sheets in the sheet feed direction. The end cursor is slidable in the sheet feed direction. The pair of gears are rotatably provided on a lower surface of a base portion of the end cursor and have the same module and the same number of teeth. The pair of racks are provided on a bottom surface of a cassette main body in parallel with each other along a slide direction of the end cursor. The pair of racks respectively mesh with the pair of gears. The image forming portion forms an image on a paper sheet conveyed from the sheet feed cassette.

Advantageous Effects of the Invention

According to the present invention, it is possible to provide a sheet feed cassette and an image forming apparatus that can prevent occurrence of a defect such as skewing, a folded edge, or a wrinkle, and can allow the end cursor to slide smoothly with excellent operability.

DESCRIPTION OF EMBODIMENTS

Hereinafter, embodiments of the present invention will be described in further detail with reference to the drawings.

Figure 1:
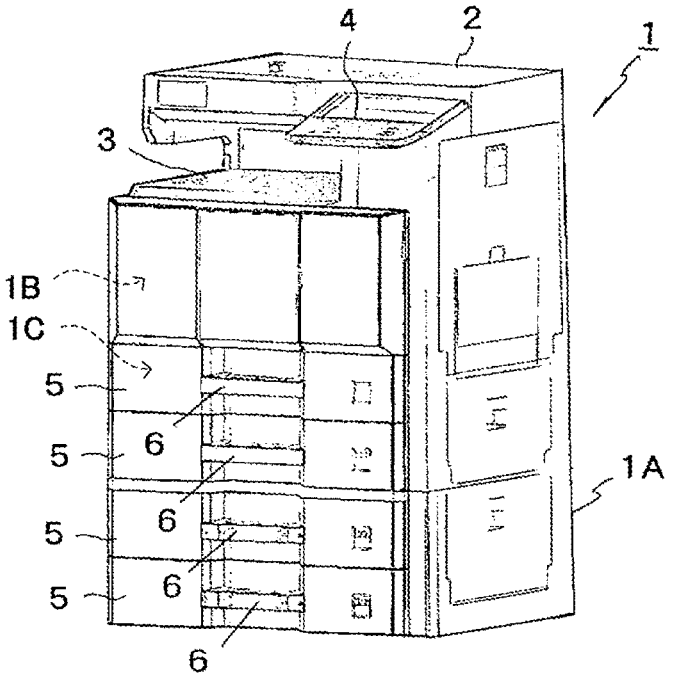
FIG. 1 is a perspective view of an image forming apparatus according to the present invention.

FIG. 1 shows a multifunction peripheral (MFP) as an embodiment of the image forming apparatus according to the present invention. As shown in FIG. 1, a document sheet reading device 2 is provided at an upper end of a multifunction peripheral 1, and a sheet discharge tray 3 for a so-called "in-body discharge" is disposed below the document sheet reading device 2. It is noted that an operation panel 4 is provided on the front side of the document sheet reading device 2.

A main body 1A of the multifunction peripheral 1 stores an image forming portion 1B, a sheet feed portion 1C, a fixing portion (not shown), a sheet discharge portion (not shown) and the like. The image forming portion 1B forms an image by the electrophotography. The sheet feed portion 1C conveys a paper sheet toward the image forming portion 1B. The fixing portion fixes a toner image transferred on the paper sheet that was conveyed by the sheet feed portion 1C, to the paper sheet. The sheet discharge portion discharges the paper sheet on which the toner image has been fixed by the fixing portion, onto the sheet discharge tray 3.

In addition, the multifunction peripheral 1 is provided with, as vertical four tiers, a plurality of sheet feed cassettes 5 in which paper sheets of various sizes are stored. The sheet feed cassettes 5 are loaded in an attachable/detachable manner to the multifunction peripheral main body 1A. A handle 6 is provided on each sheet feed cassette 5 at the center of the front part thereof, so that the sheet feed cassette 5 can be pulled frontward by gripping the handle 6 to supply paper sheets.

When an image formation operation is started in the multifunction peripheral 1, paper sheets are fed one by one by the sheet feed portion 1C from the sheet feed cassette 5 in which paper sheets of a desired size are stored, and conveyed to the image forming portion 1B. It is noted that the sheet feed portion 1C includes a pick-up roller, a conveyance roller and the like, wherein the pick-up roller picks up the paper sheets one by one from the sheet feed cassettes 5, and the conveyance roller conveys the paper sheet toward the image forming portion 1B. In the present embodiment, a device including the sheet feed cassettes 5 and the sheet feed portion 1C is an example of the paper sheet conveying device of the present invention. In the image forming portion 1B, an image is formed on a paper sheet that has been conveyed from the sheet feed cassettes 5.

Next, embodiments of the sheet feed cassettes 5 according to the present invention are described.

<Embodiment 1>

First, a sheet feed cassette 5 according to Embodiment 1 of the present invention is described with reference to FIGS. 1 through 5 in the following.

Figure 2:
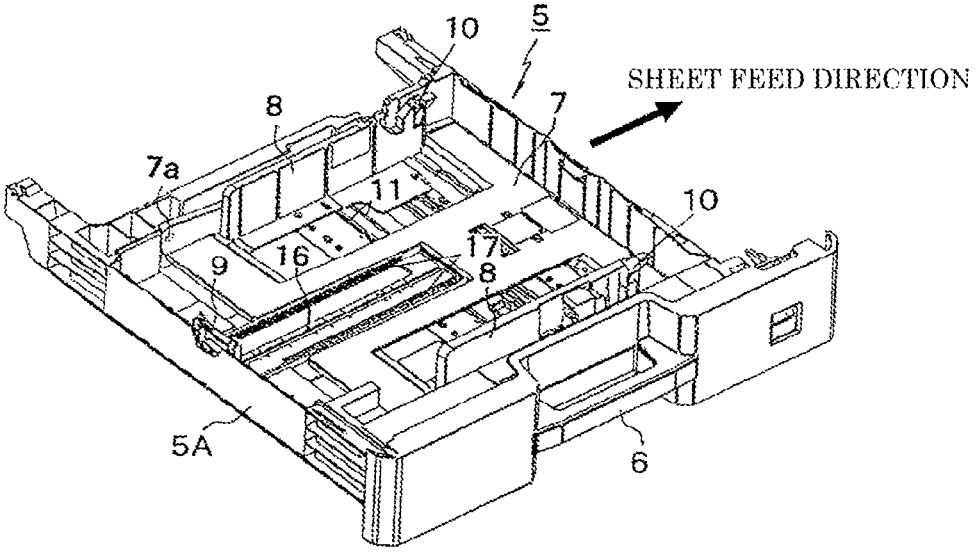
FIG. 2 is a perspective view of a sheet feed cassette according to Embodiment 1 of the present invention.
Figure 3:
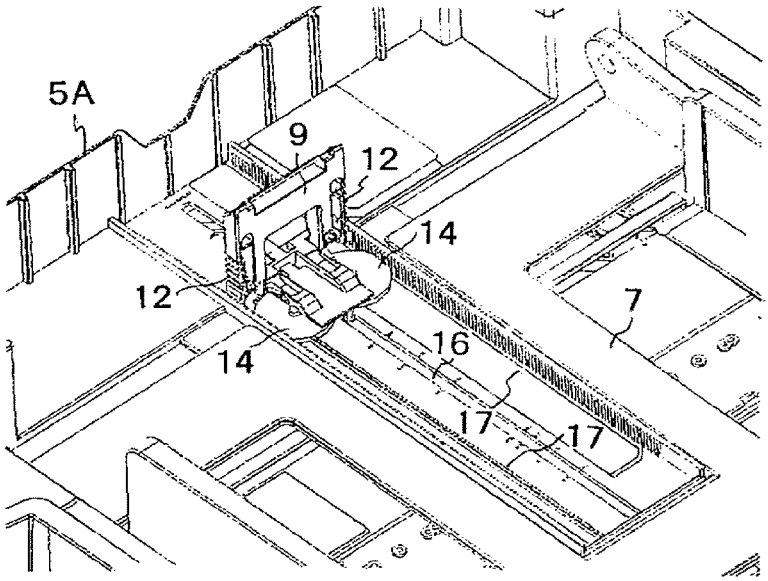
FIG. 3 is a perspective view of an end cursor, and its peripheral, of the sheet feed cassette according to Embodiment 1 of the present invention.
Figure 4:
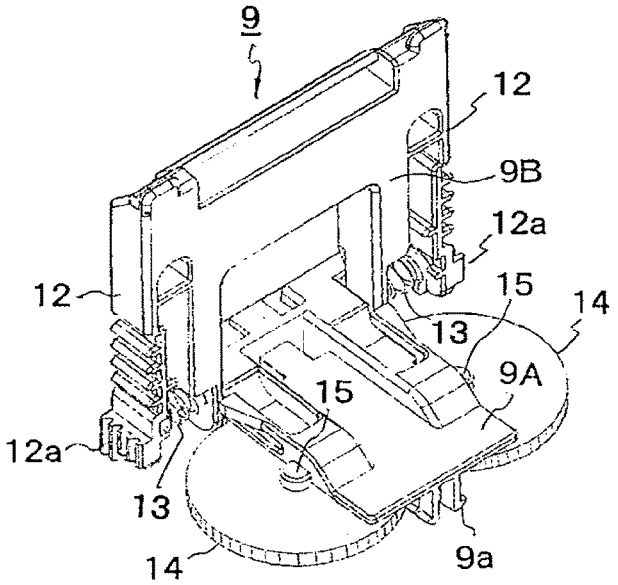
FIG. 4 is a perspective view, viewed from diagonally above, of the end cursor of the sheet feed cassette according to Embodiment 1 of the present invention.
Figure 5:
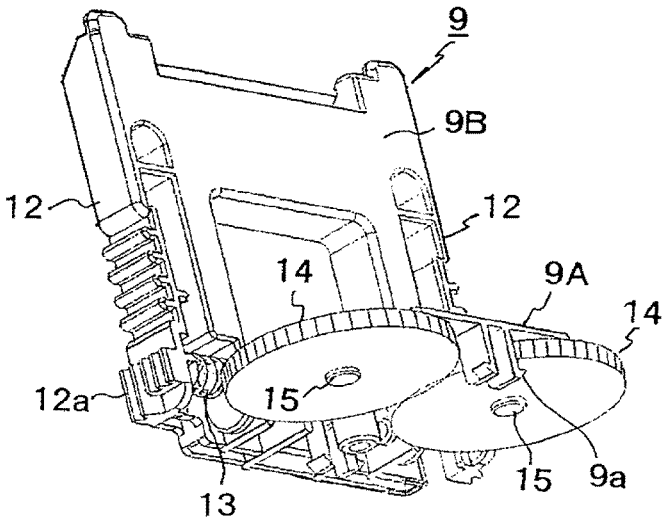
FIG. 5 is a perspective view, viewed from diagonally below, of the end cursor of the sheet feed cassette according to Embodiment 1 of the present invention.

FIG. 2 is a perspective view of a sheet feed cassette according to Embodiment 1 of the present invention. FIG. 3 is a perspective view of an end cursor, and its peripheral, of the sheet feed cassette. FIG. 4 is a perspective view of the end cursor viewed from diagonally above. FIG. 5 is a perspective view of the end cursor viewed from diagonally below.

As shown in FIG. 2, the sheet feed cassettes 5 includes a cassette main body 5A which is in the shape of a flat rectangular box whose top is opened, a paper sheet mounting plate 7, a pair of side cursors 8, and an end cursor 9. The paper sheet mounting plate 7 can sway about a fulcrum 7*a*. The pair of side cursors 8 can be slid so as to abut on opposite sides of the paper sheets mounted on the paper sheet mounting plate 7 and align the width of the paper sheets. The end cursor 9 can be slid so as to abut on the rear end of the paper sheets and align the front and rear ends of the paper sheets.

The pair of side cursors 8 are configured to be slidable in a direction (the paper sheet width direction) perpendicular to the paper sheet conveyance direction (the direction indicated by the arrow in FIG. 2). Each of the pair of side cursors 8 is provided with a knob member 10. At a lower end of each knob member 10, a claw portion (not shown) having projecting-and-recessed surface is formed. The claw portion is engaged with a rack 11 which is formed on the bottom surface of the cassette main body 5A.

In each side cursor 8, when the knob member 10 is picked and pressed, the engagement between the claw portion (not shown) and the rack 11 is disengaged, and the pair of side cursors 8 can be slid by the same amount in opposite directions along the paper sheet width direction by a rack and pinion mechanism (not shown). Subsequently, when the force pressing the knob member 10 is released, the claw portions are engaged with the racks 11 again and the sliding of the side cursor 8 is locked, and the side cursors 8 is fixed at that position.

In addition, as shown in FIGS. 4 and 5, the end cursor 9 is provided with a horizontally disposed base portion 9A and an arch-shaped vertical portion 9B which is erected vertically from an end of the base portion 9A. Arm-like knob members 12 extending vertically downward are integrally formed with the left and right ends of the vertical portion 9B, respectively. Each knob member 12 can be bent in the left-right direction with an upper end thereof as a starting point, and a claw portion 12*a* having projecting-and-recessed surface is formed on an outer surface of a lower end of each knob member 12. The claw portions 12*a* are biased outward (in the direction to be engaged with racks 17 which are described below) by springs 13 respectively.

Furthermore, a guide projection 9*a* projecting downward is provided on a lower surface of the base portion 9A at the center thereof in the width direction. In addition, a pair of bosses 15 are integrally formed with the base portion 9A to extend downward from the lower surface thereof. In addition, the pair of bosses 15 projecting from the base portion 9A rotatably support a pair of gears 14 respectively, wherein the pair of gears 14 mesh with each other and have the same module and the same number of teeth. That is, the pair of gears 14 are rotatably provided on the bottom of the end cursor 9. It is noted that, in the state where the end cursor 9 has been set in the sheet feed cassette 5, tips of the bosses 15 abut on the base of the sheet feed cassette 5, and the end cursor 9 can slide with the pair of gears 14 located between the base portion 9A and the base of the sheet feed cassette 5. Alternatively, although not shown, a flange may be provided on a circumferential surface of the center hole of each gear 14, and the end cursor 9 may be slid with the flanges abutting on the base of the sheet feed cassettes 5. It is noted that the guide projection 9*a* is provided on the lower surface of the base portion 9A of the end cursor 9, on the front side in the sheet feed direction between the pair of gears 14.

On the other hand, as shown in FIG. 3, on the bottom surface of the cassette main body 5A, a guide groove 16 is formed along the slide direction of the end cursor 9 (a direction parallel with the sheet feed direction). In addition, on the bottom surface of the cassette main body 5A, a pair of racks 17 are formed on both sides of the guide groove 16 to extend in the slide direction of the end cursor 9 in parallel with each other. The guide projection 9*a* projecting from the base portion 9A of the end cursor 9 is fitted in the guide groove 16. The guide projection 9*a* is fitted in the guide groove 16 and movable along the guide groove 16. Furthermore, the claw portions 12*a* are respectively engaged with the pair of racks 17, wherein the claw portions 12*a* are formed on the outer surfaces of the lower ends of the pair of knob members 12 provided at the left and right sides of the end cursor 9. In addition, the pair of gears 14 rotatably supported by the base portion 9A of the end cursor 9 are respectively meshed with the pair of racks 17.

When the pair of knob members 12 of the end cursor 9 are picked and pressed inward against the biasing force of the springs 13 by the snap-fit method, the knob members 12 are bent inward, and the engagement between the claw portions 12*a* under the knob members 12 and the racks 17 is disengaged. This allows the end cursor 9 to slide along the guide groove 16. When the end cursor 9 is slid along the guide groove 16, the pair of gears 14 rotatably supported by the base portion 9A of the end cursor 9 are rotated while meshing with the pair of racks 17 respectively. Here, since the gears 14 rotate without tooth skipping, the end cursor 9 slides straight, always keeping the normal attitude without being inclined. As a result, the rear end of the paper sheets stored in the sheet feed cassettes 5 is always aligned correctly by the end cursor 9, and a defect such as skewing, a folded edge, or a wrinkle is prevented from occurring when the paper sheets are fed.

In addition, the end cursor 9 slides straight and smoothly without being interrupted, thus the operability of the end cursor 9 is increased.

Subsequently, when the force pressing the pair of knob members 12 of the end cursor 9 is released, the claw portions 12*a* are engaged with the racks 17 again and the sliding of the end cursor 9 is locked, and the end cursor 9 is fixed at that position.

As described above, in the multifunction peripheral 1 shown in FIG. 1, including the sheet feed cassettes 5, a defect such as skewing, a folded edge, or a wrinkle is prevented from occurring when a paper sheet is conveyed from the sheet feed cassette 5 to the image forming portion 1B, and a high-quality image is always obtained in a stable manner.

<Embodiment 2>

Next, a sheet feed cassette according to Embodiment 2 of the present invention is described in the following with reference to FIGS. 6, 7A and 7B.

Figure 6:
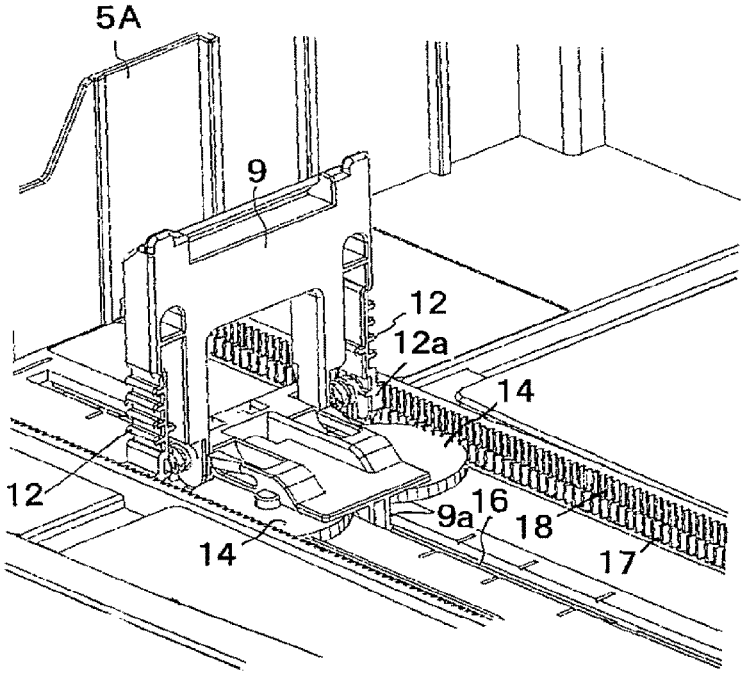
FIG. 6 is a perspective view of an end cursor, and its peripheral, of a sheet feed cassette according to Embodiment 2 of the present invention.

FIG. 6 is a perspective view of an end cursor, and its peripheral, of the sheet feed cassette according to Embodiment 2 of the present invention. FIG. 7A is a partial perspective view of a rack included in the sheet feed cassette. FIG. 7B is a partial perspective view of a ratchet teeth set included in the sheet feed cassette. In these drawings, elements that are the same as those shown in FIGS. 2 through 5 are assigned the same reference signs, and repetitive description thereof is omitted.

In the present embodiment, as shown in FIG. 6, claw portions 12*a* having projecting-and-recessed surfaces are formed respectively on the outer surfaces of the lower ends of the pair of knob members 12 of the end cursor 9, as in Embodiment 1. In addition, in the cassette main body 5A, a pair of ratchet teeth sets 18 are provided on the pair of racks 17 such that they form two layers in the vertical direction, wherein the ratchet teeth sets 18 allow the end cursor 9 to slide only in the sheet feed direction (the direction in which the end cursor 9 abuts on the rear end of the paper sheets). The claw portions 12*a* of the end cursor 9 are engaged with the ratchet teeth sets 18 respectively in an engageable/disengageable manner. The other configurations are the same as those of Embodiment 1, and the pair of gears 14 provided in the end cursor 9 mesh with the pair of racks 17 respectively.

Figure 7A:
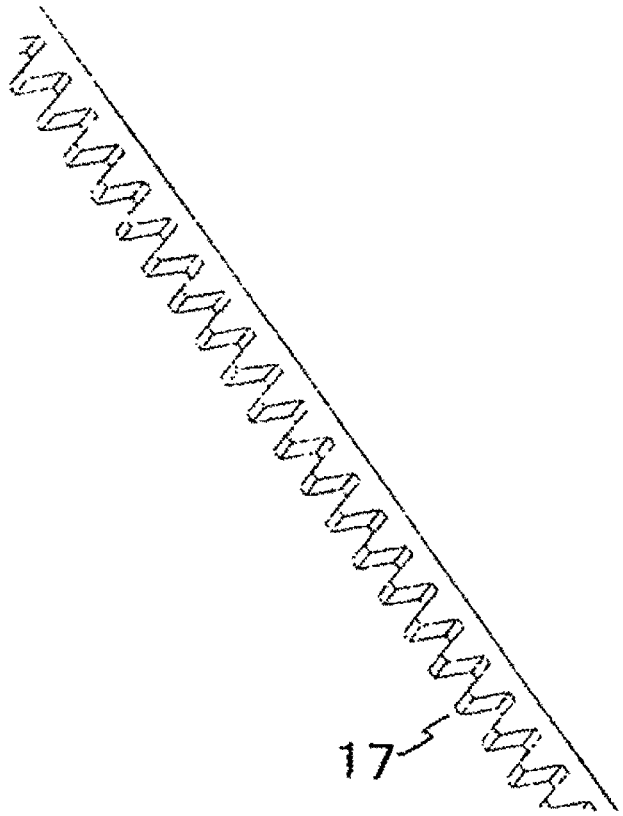
FIG. 7A is a partial perspective view of a rack included in the sheet feed cassette according to Embodiment 2 of the present invention.
Figure 7B:
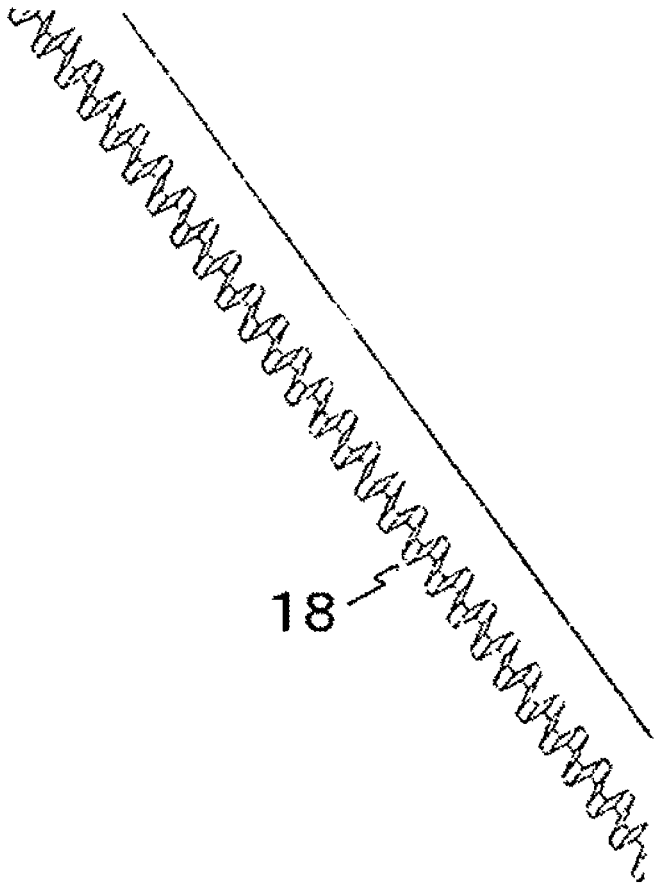
FIG. 7B is a partial perspective view of a latch teeth set included in the sheet feed cassette according to Embodiment 2 of the present invention.
Figure 8:
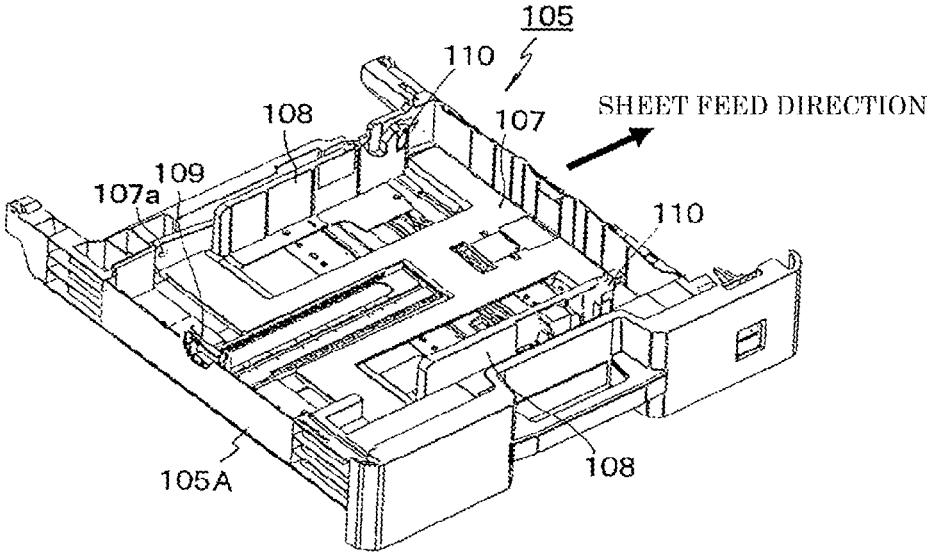
FIG. 8 is a perspective view of a conventional sheet feed cassette.
Figure 9:
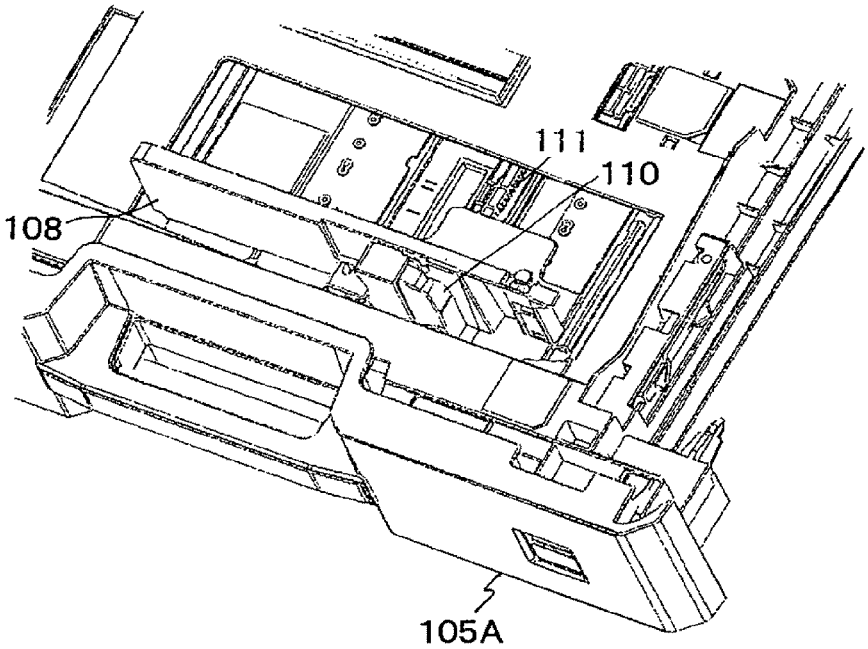
FIG. 9 is a perspective view of a side cursor, and its peripheral, of the conventional sheet feed cassette.
Figure 10:
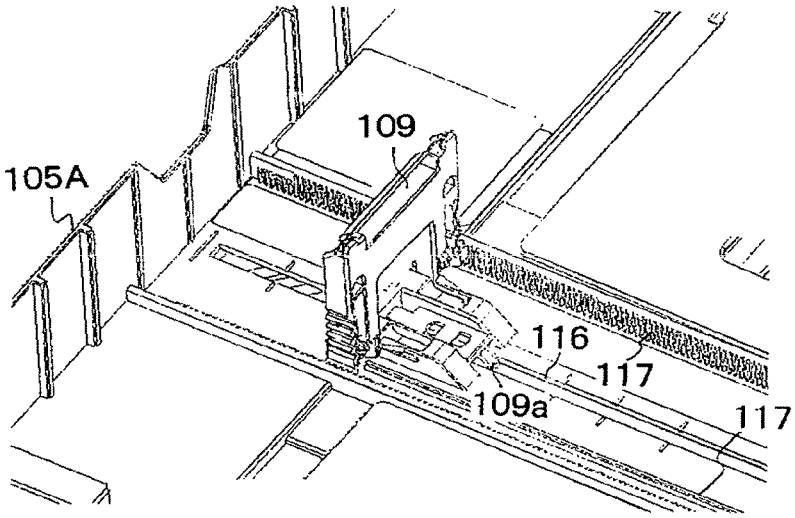
FIG. 10 is a perspective view of an end cursor, and its peripheral, of the conventional sheet feed cassette.
Figure 11:
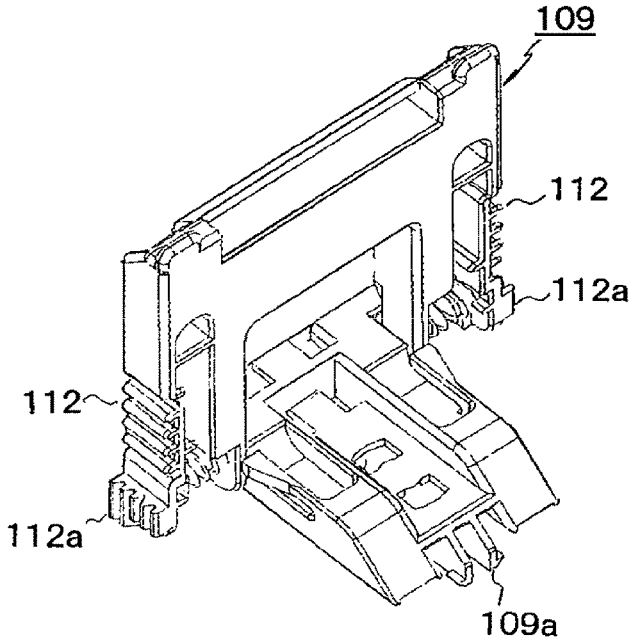
FIG. 11 is a perspective view of the end cursor of the conventional sheet feed cassette.

Here, as shown in FIG. 7A, each tooth of the racks 17 has the same angle in both the sheet feed direction (a direction in which the end cursor 9 abuts on the paper sheets) and an anti-sheet-feed direction (a direction in which the end cursor 9 is separated from the paper sheets). On the other hand, as shown in FIG. 7B, each tooth of the ratchet teeth sets 18 has a smaller angle in the sheet feed direction than in the anti-sheet-feed direction, and the angle in the anti-sheet-feed direction is set to approximately a right angle. With the tooth angle of the ratchet teeth sets 18 set in this way, the end cursor 9 can be slid in the sheet feed direction without operating the knob members 12, but cannot be slid in the anti-sheet-feed direction without operating the knob members 12. It is noted that, when a paper sheet is fed, the rear end of the stack of paper sheets acts on the end cursor 9 and attempts to move the end cursor 9 in the anti-sheet-feed direction. However, in the present embodiment, by using the ratchet teeth sets 18 whose tooth angle is set as described above, the end cursor 9 is prevented from moving in the anti-sheet-feed direction.

As described above, according to the present embodiment, the operability of the end cursor 9 is further increased because, when the end cursor 9 is slid in the direction to abut on the paper sheets, the end cursor 9 can be slid and fixed at a desired position without operating the knob members 12. In addition, when the end cursor 9 is slid in the direction to separate from the paper sheets, the end cursor 9 can be slid if the pair of knob members 12 of the end cursor 9 are pressed to disengage the engagement between the claws 12*a* and the ratchet teeth sets 18. It is noted that in this case too, the pair of gears 14 mesh with the pair of racks 17 as in Embodiment 1, thus the end cursor 9 can be slid straight and smoothly without being inclined.

In the present embodiment, the pair of gears 14 that are rotatably supported by the end cursor 9 are configured to mesh with each other. As a result, the phases of both gears are matched, and the end cursor 9 can always be slid straight without being inclined.

Up to now, a description has been given of configurations which each include a multifunction peripheral and a sheet feed cassette to both of which the present invention is applied, wherein the sheet feed cassette is loaded in the multifunction peripheral in an attachable/detachable manner. However, of course, the present invention is applicable to another arbitrary image forming apparatus, such as a standalone facsimile, copier, or printer, other than the multifunction peripheral, and to a sheet feed cassette that is loaded in the image forming apparatus in an attachable/detachable manner.

REFERENCE SIGNS LIST

1 multifunction peripheral (image forming apparatus)
1A multifunction peripheral main body
2 image reading device
3 sheet discharge tray
4 operation panel
5 sheet feed cassette
5A cassette main body
6 handle of the sheet feed cassette
7 paper sheet mounting plate
8 side cursor
9 end cursor
9A base portion of the end cursor
9B vertical portion of the end cursor
9*a* guide projection of the end cursor
10 knob member of the side cursor
11 rack
12 knob member of the end cursor
12*a* claw portion of the knob member
13 spring
14 gear
15 shaft
16 guide groove
17 rack
18 ratchet teeth set

The invention claimed is:

1. A sheet feed cassette comprising:

an end cursor configured to be slidable in a sheet feed direction and regulate a rear end position of stored paper sheets in the sheet feed direction;

a pair of gears rotatably provided on a lower surface of a base portion of the end cursor and having a same module and a same number of teeth; and a pair of racks provided on a bottom surface of a cassette main body in parallel with each other along a slide direction of the end cursor, and respectively meshing with the pair of gears, wherein the end cursor includes a pair of claw portions having projecting-and-recessed surfaces, and in the cassette main body, a pair of latch teeth sets that allow the end cursor to slide only in the sheet feed direction are provided such that the latch teeth sets and the racks form two layers in a vertical direction, and the claw portions are respectively engaged with the latch teeth sets in an engageable/disengageable manner.

2. The sheet feed cassette according to claim 1, wherein the pair of gears mesh with each other.

3. The sheet feed cassette according to claim 1, wherein the pair of claw portions are respectively engaged with the pair of racks in an engageable/disengageable manner.

4. The sheet feed cassette according to claim 1 further comprising:

a guide groove formed on a bottom surface of the cassette main body and extending between and in parallel with the pair of racks; and a guide projection provided between the pair of gears on a front side in the sheet feed direction, on the lower surface of the base portion of the end cursor, and configured to be movable while being fitted in the guide groove.

5. A paper sheet conveying device comprising:

a sheet feed cassette; and a sheet feed portion configured to convey paper sheets stored in the sheet feed cassette, the sheet feed cassette including:

an end cursor configured to be slidable in a sheet feed direction and regulate a rear end position of the stored paper sheets in the sheet feed direction;

a pair of gears rotatably provided on a lower surface of a base portion of the end cursor and having a same module and a same number of teeth; and a pair of racks provided on a bottom surface of a cassette main body in parallel with each other along a slide direction of the end cursor, and respectively meshing with the pair of gears, wherein the end cursor includes a pair of claw portions having projecting-and-recessed surfaces, and in the cassette main body, a pair of latch teeth sets that allow the end cursor to slide only in the sheet feed direction are provided such that the latch teeth sets and the racks form two layers in a vertical direction, and the claw portions are respectively engaged with the latch teeth sets in an engageable/disengageable manner.

6. An image forming apparatus comprising:

a sheet feed cassette; and an image forming portion configured to form an image on a paper sheet conveyed from the sheet feed cassette, the sheet feed cassette including:

an end cursor configured to be slidable in a sheet feed direction and regulate a rear end position of the stored paper sheets in the sheet feed direction;

a pair of gears rotatably provided on a lower surface of a base portion of the end cursor and having a same module and a same number of teeth; and a pair of racks provided on a bottom surface of a cassette main body in parallel with each other along a slide direction of the end cursor, and respectively meshing with the pair of gears, wherein the end cursor includes a pair of claw portions having projecting-and-recessed surfaces, and in the cassette main body, a pair of latch teeth sets that allow the end cursor to slide only in the sheet feed direction are provided such that the latch teeth sets and the racks form two layers in a vertical direction, and the claw portions are respectively engaged with the latch teeth sets in an engageable/disengageable manner.

* * * * *